US006824322B2

(12) United States Patent
Miyajima

(10) Patent No.: US 6,824,322 B2
(45) Date of Patent: Nov. 30, 2004

(54) RECEIPT ISSUING METHOD AND RECEIPT PRINTER

(75) Inventor: Takeo Miyajima, Kanagawa (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

(21) Appl. No.: 10/286,877

(22) Filed: Nov. 4, 2002

(65) Prior Publication Data

US 2003/0086740 A1 May 8, 2003

(30) Foreign Application Priority Data

Nov. 5, 2001 (JP) ..... 2001-339207

(51) Int. Cl.[7] ..... B41J 11/26; B41J 21/17; B41J 45/00

(52) U.S. Cl. ..... 400/621; 400/70; 400/624; 101/66

(58) Field of Search ..... 400/645.1, 586, 400/584, 636.1, 621, 70, 582, 619, 624; 101/91, 66; 271/186, 291

(56) References Cited

U.S. PATENT DOCUMENTS

| | | | | | |
|---|---|---|---|---|---|
| 3,774,530 | A | * | 11/1973 | Woodie et al. | 101/66 |
| 4,094,244 | A | * | 6/1978 | Edwards et al. | 101/66 |
| 4,188,138 | A | * | 2/1980 | Yamazaki | 400/586 |
| 4,196,665 | A | * | 4/1980 | Rogers et al. | 101/66 |
| 4,211,498 | A | * | 7/1980 | Shimizu et al. | 400/621 |
| 4,264,218 | A | * | 4/1981 | Okabe et al. | 400/78 |
| 5,505,552 | A | * | 4/1996 | Hasegawa et al. | 400/621 |
| 5,879,090 | A | * | 3/1999 | Hoyt et al. | 400/578 |
| 5,971,639 | A | * | 10/1999 | Park | 400/621 |
| 6,062,748 | A | | 5/2000 | Shimizu et al. | 400/70 |
| 6,074,113 | A | * | 6/2000 | Cockerill et al. | 400/621 |
| 6,271,872 | B1 | * | 8/2001 | Nagata | 347/171 |
| 6,290,129 | B2 | * | 9/2001 | Momose | 235/449 |
| 6,293,542 | B1 | * | 9/2001 | Bokelman | 271/186 |
| 6,367,731 | B1 | * | 4/2002 | Takizawa et al. | 242/417.3 |
| 6,375,297 | B1 | * | 4/2002 | Hayashi et al. | 347/14 |
| 6,398,212 | B1 | * | 6/2002 | Miyake | 271/186 |
| 6,478,490 | B2 | * | 11/2002 | Kelley et al. | 400/624 |
| 6,556,231 | B2 | * | 4/2003 | Nishimura | 347/218 |
| 6,652,173 | B1 | * | 11/2003 | Martini et al. | 400/621 |

FOREIGN PATENT DOCUMENTS

| | | |
|---|---|---|
| JP | 1-159790 | 6/1989 |
| JP | 5-58288 | 8/1993 |
| JP | 7-182565 | 7/1995 |
| JP | 10-198865 | 7/1998 |

* cited by examiner

*Primary Examiner*—Andrew H. Hirshfeld
*Assistant Examiner*—Wasseem H. Hamdan
(74) *Attorney, Agent, or Firm*—Foley & Lardner LLP

(57) ABSTRACT

A receipt issuing method and a receipt printer capable of smoothly performing a receipt issuing operation even if it takes relatively long time to print header information such as a logo. In time period from the detection of input of a print instruction to the completion of output and cutoff of a receipt, only a dealing information print processing and paper feed are executed so as to promptly issue the receipt. In standby time period right after issuance of the receipt is completed and before a data input operation for dealing with a next customer starts, the header information is printed to include time required to print the header information in the standby time. By doing so, even if it takes long time to perform a header information print operation, it is possible to prevent time required to perform the substantial receipt issuing operation itself from increasing.

8 Claims, 8 Drawing Sheets

RECEIPT ISSUING METHOD AND RECEIPT PRINTER

BACKGROUND OF THE INVENTION

1. Field of the Invention

The present invention relates to an improved receipt issuing method and an improved receipt printer. More specifically, the present invention relates to a receipt issuing method and a receipt printer capable of smoothly performing a receipt issuing operation even if a print head which operates relatively slow is employed.

2. Description of the Related Art

Conventionally, the types of receipt printers for business use are roughly divided into a line thermal type employing thermal paper and a dot impact type. Recently, however, as POS (point-of-sales information management) terminals have advanced to multimedia terminals, the possibility of the advancement from conventional monochrome printing to two-color printing employing two-color thermal paper, and further to multicolor printing employing inkjet technique so as to impart a value added to receipt printing has arisen.

However, to print colors on, for example, a two-color thermal paper sheet, it is normally necessary to approximately double thermal energy and to lengthen heating time for heating a thermal paper sheet. As a result, it is necessary to decrease printing speed. In addition, if multicolor is realized by means of the inkjet technique, the problem of slow printing speed remains.

On the other hand, in the field of receipt printers each employing a print head capable of printing at relatively a high speed, Japanese Patent Unexamined Application Publication No. 7-182565 discloses a method and apparatus for reducing time required to issue the next receipt by actuating a print head to print header information on the surface of the next receipt while a final printing position of the present receipt is fed up to the position of a cutter to accelerate a receipt issuing operation.

This method and apparatus can reduce the time required to perform the receipt issuing operation because it is unnecessary to print the header information and it is instead possible to instantly print dealing information during the next receipt issuing processing.

However, even if the technique disclosed in the Japanese Patent Unexamined Application Publication No. 7-182565 is applied to an inkjet or thermal receipt printer, it is difficult to reduce the overall time required to perform receipt issuing operations for the following reason. In the inkjet or thermal receipt printer, the operation of the print head itself is slow. Due to this, if the header information is printed on a receipt while the receipt is fed out, it is required to decrease a receipt feeding speed. This disadvantageously increases time required to output a receipt, thereby deteriorating overall operation efficiency.

This disadvantage becomes more conspicuous if a lower-speed print head is used. Thus, it is quite a serious obstacle if two-color printing or multicolor printing is conducted by the inkjet or thermal receipt printer.

SUMMARY OF THE INVENTION

It is, therefore, an object of the present invention to provide a receipt issuing method and a receipt printer capable of solving the conventional disadvantages, and particularly enabling a receipt issuing operation to be smoothly performed even if it takes relatively long time to print header information, such as a logo, on each receipt on the assumption that two-color printing or multicolor printing is frequently used in a stamp logo portion in which the logo of a shop or a chain store is printed.

According to a first aspect of the present invention, there is provided a receipt issuing method for issuing a receipt comprising the steps of: printing dealing information with a print head while feeding a receipt sheet in forward direction with a transporter; feeding said receipt sheet in the forward direction with said transporter until an end of said receipt reaches about a cutter; cutting the receipt sheet with said cutter to make a cutoff portion of said receipt sheet into said receipt; feeding said receipt sheet in reverse direction with said transporter until a top of said receipt sheet reaches about said print head; and printing header information with said print head while feeding said receipt sheet in the forward direction with said transporter.

According to a second aspect of the present invention, there is provided a receipt issuing method for issuing a receipt comprising the steps of: printing dealing information with a print head while feeding a receipt sheet in forward direction with a transporter; feeding said receipt sheet in the forward direction with said transporter until an end of said receipt reaches about a manual cutter; detecting whether or not the receipt sheet has cut with said manual cutter to make a cutoff portion of said receipt sheet into said receipt; if it is detected that the receipt sheet has cut, feeding said receipt sheet in reverse direction with said transporter until a top of said receipt sheet reaches about said print head; and printing header information with said print head while feeding said receipt sheet in the forward direction with said transporter.

DESCRIPTION OF THE PREFERRED EMBODIMENTS

Figure 1:
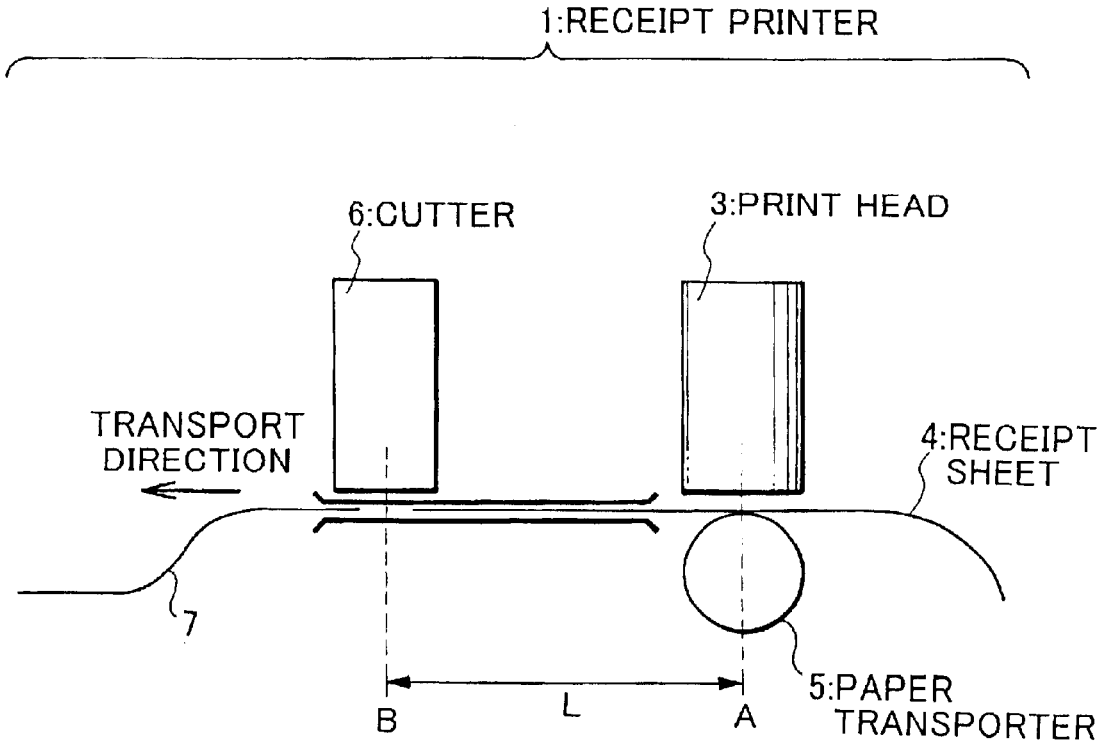
FIG. 1 is a typical view showing the arrangement of the mechanical constituent elements of a receipt printer in one embodiment, to which a receipt issuing method according to the present invention is applied, in a simplified manner.
Figure 2:
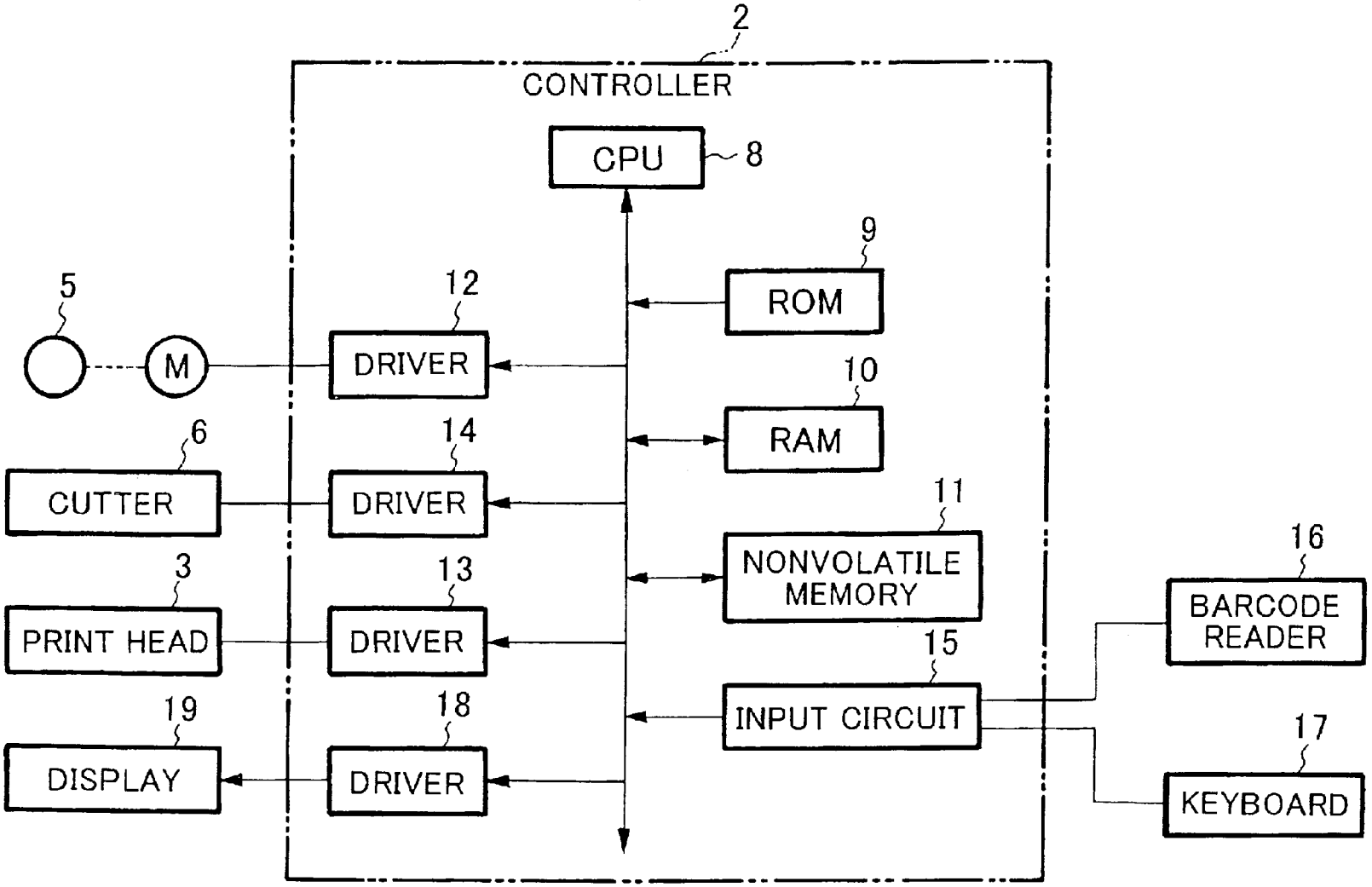
FIG. 2 is a functional block diagram showing the important portions of a controller which controls the driving of the receipt printer in this embodiment.

The embodiments of the present invention will be described hereinafter in detail with reference to the drawings. FIG. 1 is a typical view showing the arrangement of the mechanical constituent elements of a receipt printer 1 in one embodiment, to which a receipt issuing method according to the present invention is applied, in a simplified manner. FIG. 2 is a functional block diagram showing the important parts of a controller 2 which controls the driving of the respective portions of the receipt printer 1 in this embodiment.

As shown in FIG. 1, the receipt printer 1 in this embodiment includes a print head 3 which prints header information common to receipts and dealing information specific to each receipt, paper transporter 5 which transports a receipt sheet 4 in a forward or a backward direction, and a cutter 6 which cuts off a printed portion at the tip end of the receipt sheet 4 to make the cutoff portion into a receipt 7. The cutter 6 is disposed forward of the print head 3 with respect to a forward direction of movement of the receipt sheet 4 by the paper transporter 5.

As the print head 3, a well-known inkjet or thermal print head can be used. The paper transporter 5 in this embodiment consists of a paper feed roller which also serves as a platen. Alternatively, the paper transporter 5 may consist of a sprocket tractor, a transport belt or the like. This paper transporter 5 is driven in a forward direction and a backward direction by a motor M shown in FIG. 2. The cutter 6 consists of a cutting blade which pushes and cuts off the receipt sheet 4, a solenoid which drives the cutting blade, and the like. Various configurations of each of the print head 3, the paper transporter 5, the cutter 6 are already well known. The differences in configurations do not impose some restrictions to the functions of the receipt printer 1 in the present embodiment. Therefore, these constituent elements 3, 5, and 6 will not be described herein in detail.

As shown in FIG. 1, a certain distance is kept between a printing position "A" at which the print head 3 prints information on the receipt sheet 4 and a cutting position "B" at which the cutter 6 cuts off the receipt sheet 4. Due to this, in order that the printed portion at the tip end of the receipt sheet 4 is cut off to make it into a receipt 7, it is necessary to feed the receipt sheet 4 in a forward direction until the final printing position on the receipt sheet 4 reaches the position of the cutter 6 before actuating the cutter 6. In this embodiment, this feed distance is denoted by a numeral "L".

As shown in FIG. 2, the controller 2 which controls the driving of the motor M of the paper transporter 5, the print head 3 and the cutter 6, schematically consists of a CPU 8 which performs various arithmetic operations, a ROM 9 which stores the drive control program for the CPU 8, and a RAM 10, a nonvolatile memory 11 and the like which are employed to temporarily store arithmetic data. The motor M, the print head 3, and the cutter 6 are controlled to be driven in response to instructions from the CPU 8 through drivers 12, 13 and 14, respectively.

Figure 3:
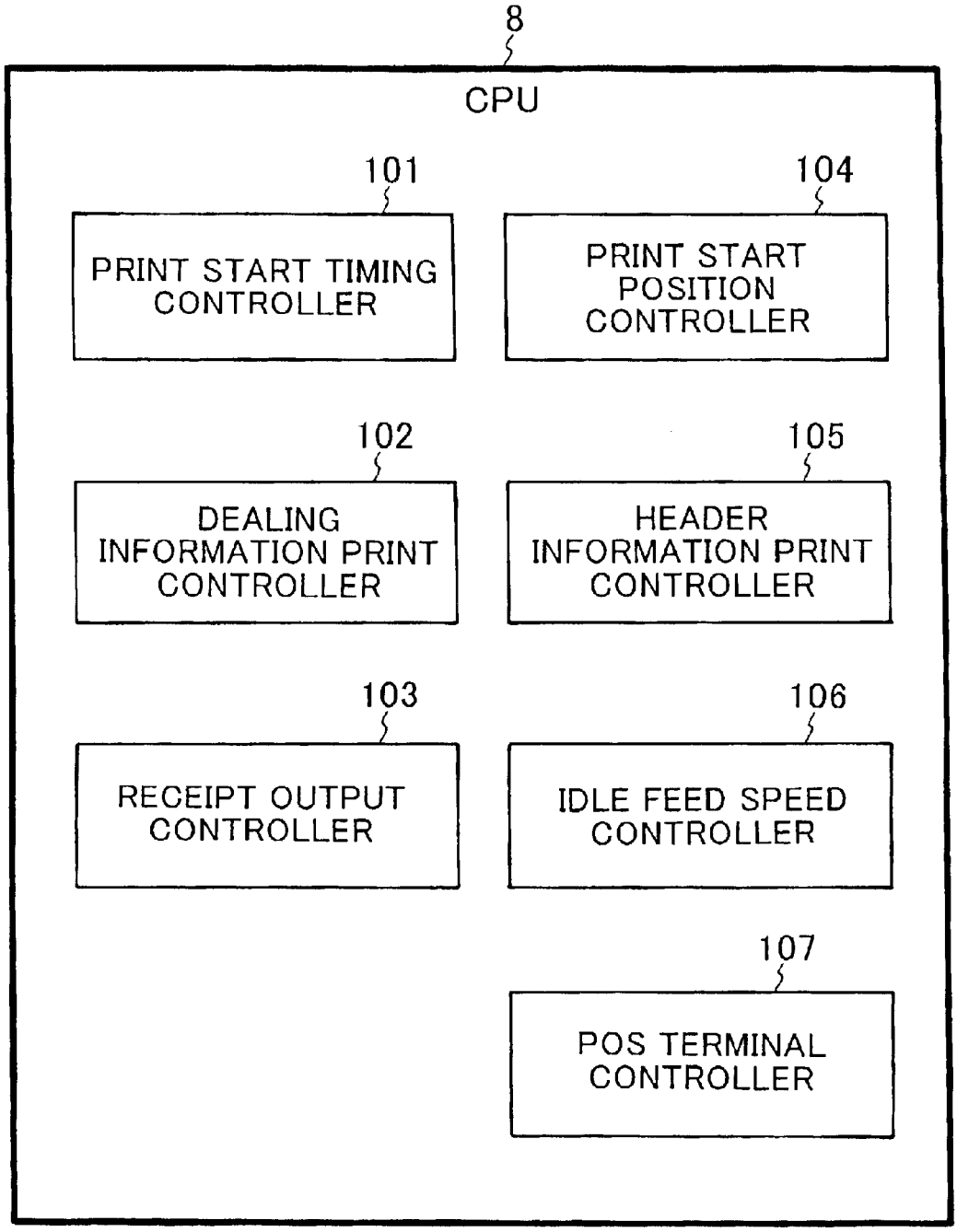
FIG. 3 is a block diagram showing function blocks of a CPU.

Further, the CPU 8 serves as a POS (point-of-sales information management) terminal controller 107 as shown in FIG. 3, so that the CPU 8 executes arithmetic operations and the like on product prices input from a barcode reader 16 or a keyboard 17 through an input circuit 15 and displays the processing result on a display through a driver 18.

Figure 4:
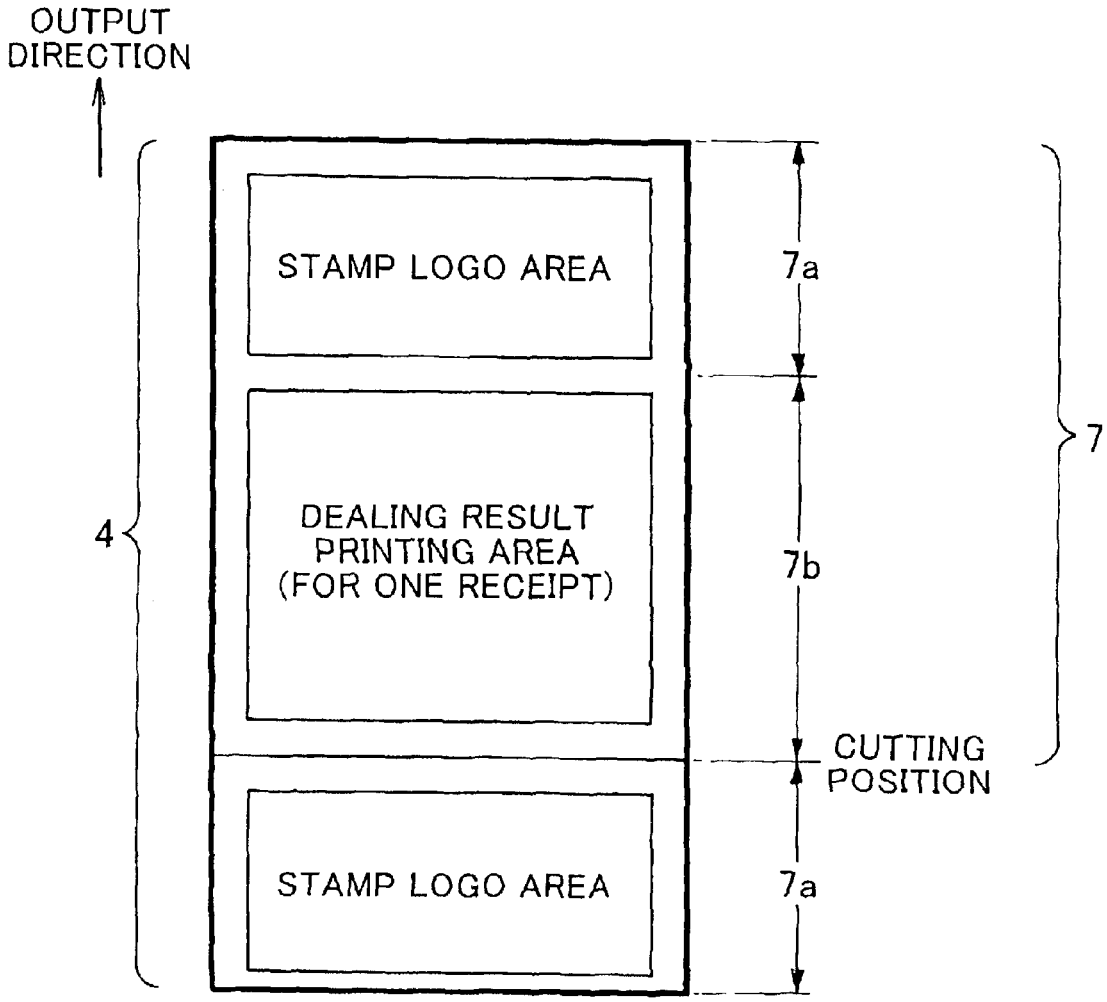
FIG. 4 is a conceptual view showing one example of a receipt output from the receipt printer in this embodiment.

FIG. 4 is a conceptual view showing one example of the receipt 7 output from the receipt printer 1 in this embodiment.

As shown in FIG. 4, the receipt 7 consists of a stamp logo area 7*a* for printing header information common to all receipts, for example, a logo and the like of a shop or a chain store, and a dealing result printing area 7*b* for printing dealing information specific to each receipt 7, i.e., the abbreviations and unit prices of products which a customer bought in a present dealing, a total amount of money of the products, a deposit, changes and the like.

Among these pieces of printing data, the printing data related to the header information is stored in the nonvolatile memory 11 in advance and the printing data related to the dealing information is read from the RAM 10 when each dealing is finished. Each of the printing data is printed by the print head 3 on the receipt sheet 4 at a predetermined position.

If the inkjet or thermal print head 3 or the like is used, the header information, such as the name of a shop and the logo of a chain store, printed on the stamp log area 7*a* is printed by two-color printing or multicolor printing to produce a visual effect. The pieces of data, such as the abbreviations and unit prices of products, the total amount of money of the products, the deposit and the changes, printed on the dealing result printing area 7*b* are all printed by monochrome printing to accelerate the receipt issuing operation.

Arbitrary information, patterns and the like including a notice to customers and an advance notice of an event can be also set as the header information to be printed on the stamp log area 7*a*.

The receipt 7 is originally a part of the long receipt sheet 4. The cutter 6 cuts off the printed portion of this receipt sheet 4, i.e., the portion of the stamp logo area 7*a* and the dealing result printing area 7*b*, whereby a single receipt 7 corresponding to one dealing is provided.

Figure 5:
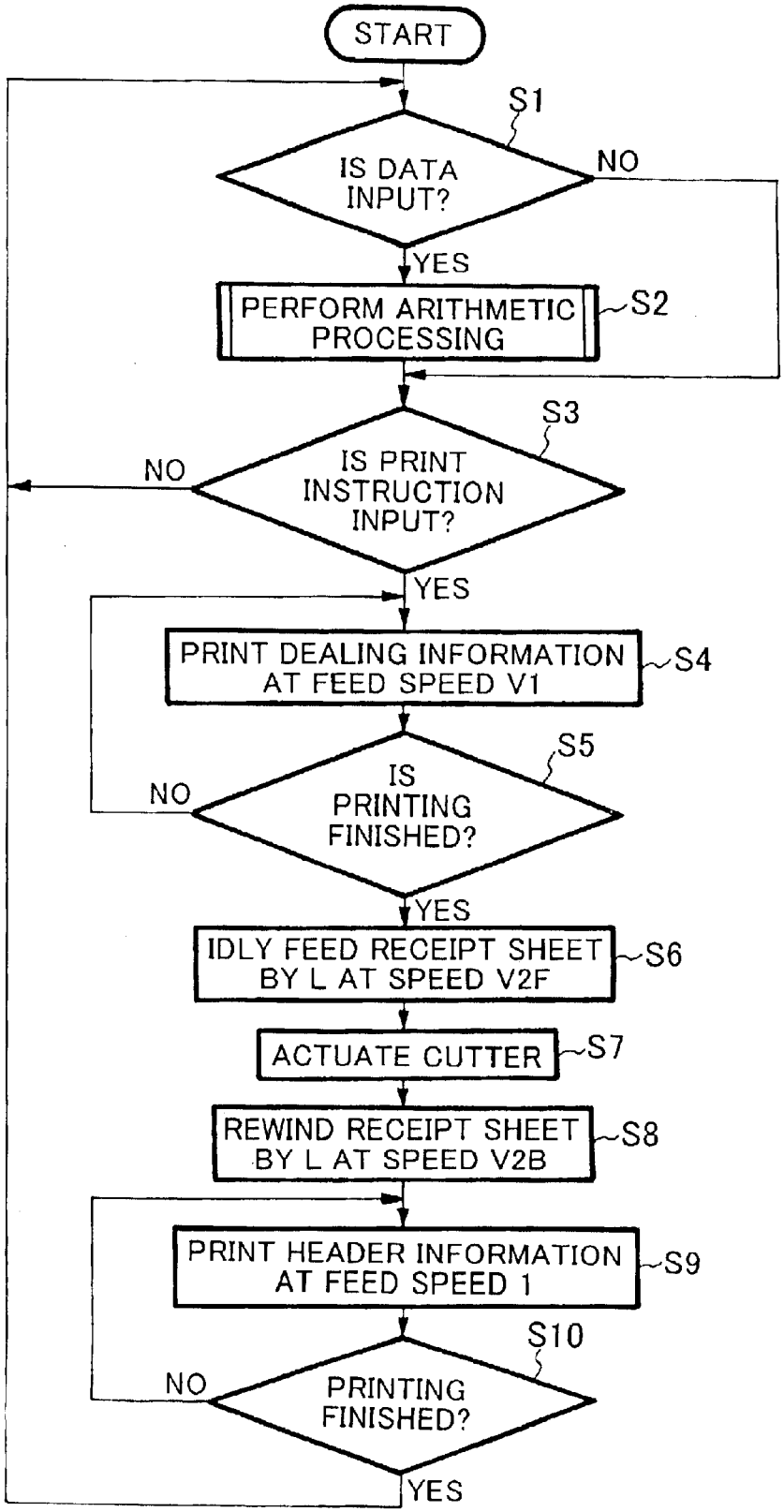
FIG. 5 is a flow chart showing the schematic of a receipt issuing processing executed by a CPU which is arranged in the controller of the receipt printer in this embodiment.

The processing operations of the CPU 8, which functions as a print start timing controller 101, a dealing information print controller 102, a receipt output controller 103, a print start position controller 104, a header information print controller 105,.and an idle feed speed controller 106, as shown in FIG. 3, will next be described with reference to the flow chart of FIG. 5 showing the schematic of the receipt issuing processing executed by the CPU 8 and the function/principle views of FIGS. 6A to 6D.

When starting a receipt issuing processing, the CPU 8 first determines whether or not data related to the dealing of products is input from the barcode reader 16 or the keyboard 17 (in a step S1).

If there is no data input, the CPU 8, which functions as the print start timing controller 101, determines whether or not a print instruction output from the dealing complete key of the keyboard 17 is input, i.e., whether or not dealing information to be printed has been already generated at this stage (in a step S3). If the print instruction which means an instruction to complete the generation of the dealing information and to execute print is not input, the CPU 8 repeatedly executes the determination processings only in the steps S1 and S3, then turning into a standby state in which the CPU 8 awaits the input of data or the input of a print instruction.

If the data related to the present dealing is input during this time, the CPU 8, which functions as the POS terminal controller 107, executes arithmetic processings including an addition processing for adding the amounts of money of the products which the customer bought, a multiplication processing in case the customer bought a plurality of products of one type, and a subtraction processing for subtracting the amount of money of the products from the deposit, and temporarily stores arithmetic processing results in the RAM 10 (in a step S2).

Figure 6A:
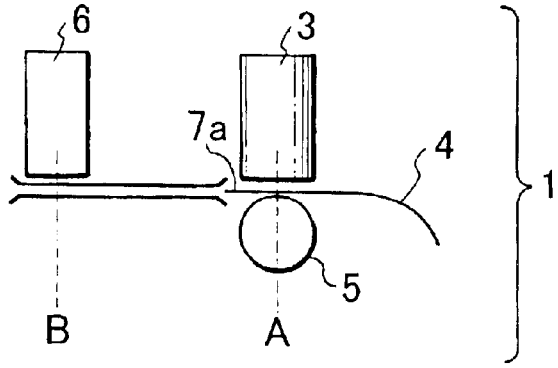
FIGS. 6A to 6D are function/principle views showing the operating states of the receipt printer in this embodiment.
Figure 6B:
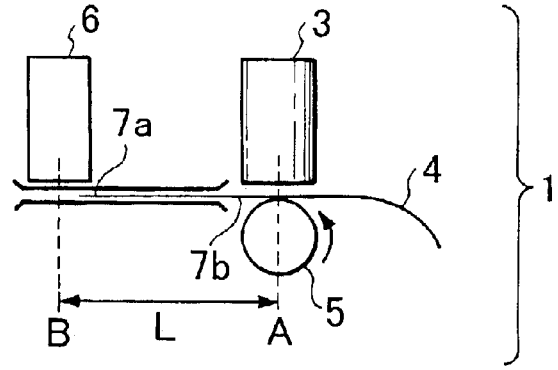

FIG. 6A is a function/principle view showing the state of the receipt printer 1 when the CPU 8 is in a standby state. At this stage, it is assumed that the header information is already printed in the stamp logo area 7*a* on the tip end of the receipt sheet 4 and that the final printing position of the stamp logo area 7*a* is positioned to the printing position A on a paper transport path. In this embodiment, it is necessary to hold the stamp logo area 7*a* on which the information is already printed, between the printing position A and the cutting position B. Due to this, it is necessary to design the distance L between the printing position A and the cutting position B to be equal to or longer than the length of the stamp logo area 7*a*.

When one dealing is finished and the CPU 8, which functions as the print start timing controller 101, detects the input of the print instruction which is output in response to the operation of the dealing complete key by the determination processing in the step S3, the CPU 8, which functions as the dealing information print controller 102, drives the paper transporter 5 and starts to actuate the print head 3 while feeding the receipt sheet 4 in the forward direction at a paper feed speed V1, and continuously controls the driving of the paper transporter 5 and the print head 3 until all pieces of dealing information read from the RAM 10 are printed on the receipt sheet 4 (in steps S4 and S5).

The paper feed speed V1 at this time is determined according to the cooperative operation of the paper transporter 5 with the print head 3, and limited by the ability of the printing speed of the print head 3.

Figure 7:
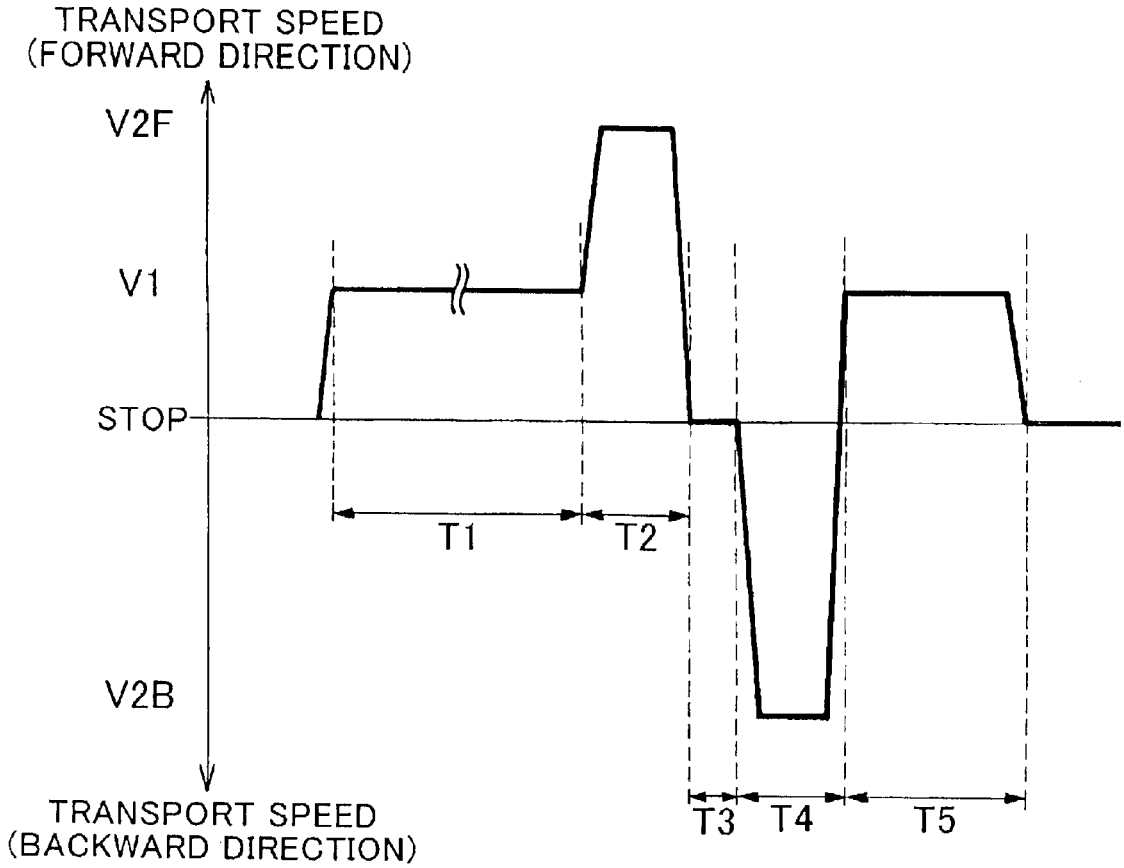
FIG. 7 is a timing chart showing the transport state of a receipt sheet in the receipt printer in this embodiment.

A time period, in which the paper is fed at the speed V1 for printing the dealing information continues, is denoted by reference T1 in the timing chart of FIG. 7.

If the pieces of dealing information read from the RAM 10 are all printed on the receipt sheet 4 and the determination result of the step S5 becomes "yes", the final print position of the dealing result print area 7*b* on which the dealing information is printed is positioned at the printing position A on the paper transport path.

If the CPU 8 detects that the printing of the dealing information is finished as stated above, the CPU 8, which functions as the receipt output controller 103 and the idle feed speed controller 106, changes the paper feed speed from V1 to V2F, and drives the paper transporter 5 at the speed V2F, to idly feed the receipt sheet 4 in the forward direction by the distance L by which the final printing position on the receipt sheet 4 in the dealing result printing area 7*b* reaches the cutting position B on the paper transport path (in a step S6). Thereafter, the CPU 8 actuates the cutter 6 to cut off the printed portion consisting of the stamp logo area 7*a* and the dealing result printing area 7*b* in which the information is printed, from the tip end of the receipt sheet 4, and issues the cut portion as a receipt 7 corresponding to the present dealing (in a step S7).

The receipt 7 thus issued is normally given to the customer together with changes at this stage, and a register clerk turns into a standby state for awaiting the servicing the next customer or the input of dealing information on the next customer.

Since the print head 3 does not operate while the receipt output controller 103 is operative, no special restriction is imposed to the paper feed speed V2F. Therefore, it is preferable that the speed V2F is set at a high speed in a range in which troubles such as the jamming of receipts 7 do not occur, so as to reduce time required to issue each receipt 7.

A time period, in which the paper feed speed V2F for idly feeding the receipt sheet 4 continues, is denoted by reference T2 and a time period required for the cutter 6 to perform a cutting operation is denoted by reference T3 in FIG. 7.

Figure 6C:
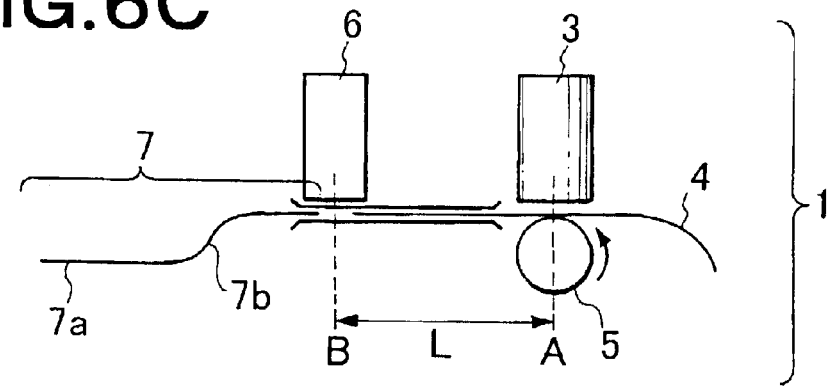

FIG. 6C shows the state of the receipt printer 1 when the cutter 6 completes with cutting off the receipt sheet 4 into the receipt 7. It is noted, however, that the number of lines of the dealing information printed on the receipt sheet 4, i.e. the length of the dealing result printing area 7*b* changes according to the volume of the articles which the customer bought or the like. Due to this, even if the length of the stamp logo area 7*a* and the idle feed distance L from the final printing position of the dealing result printing area 7*b* is constant, the entire length of the receipt 7 which consists of the stamp logo area 7*a* and the dealing result printing area 7*b* variably changes according to the dealing.

If the cutter 6 finishes the cutting operation, the CPU 8, which functions as the print start position controller 104 and the idle feed speed controller 106, changes the paper feed speed from V2F to V2B, drives the paper transporter 5 in the backward direction at the speed V2B to rewind the receipt sheet 4 by feeding the receipt sheet 4 in the backward direction by the distance L by which the tip end of the receipt sheet 4 thus cut off is rewound to the printing position A on the paper transport path (in a step S8).

Since the print head 3 does not operate while the print start position controller 104 is operative, no special restriction is imposed to the paper feed speed V2B. Therefore, it is preferable that the speed V2B is set at a high speed in a range in which troubles such as the jamming of the receipt sheet 4 do not occur, so as to reduce the standby time required until the input operation for dealing information on the next customer starts.

A time period, in which the paper feed speed V2B for rewinding the receipt sheet 4 continues, is denoted by reference T4 in the timing chart of FIG. 7.

Figure 6D:
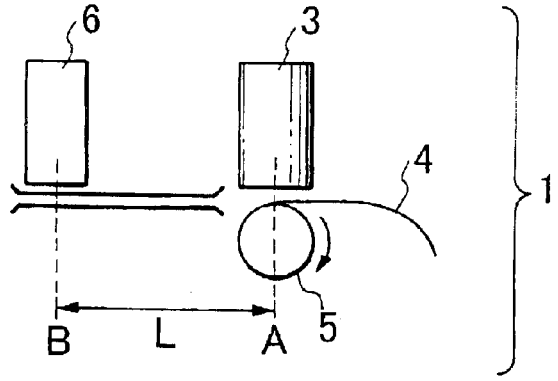

FIG. 6D shows the state of the receipt printer 1 when the rewinding of the receipt sheet 4 is completed. In this state, the tip end of the receipt sheet 4 is positioned at the printing position A on the paper transport path.

If the rewinding of the receipt sheet 4 is completed as stated above, the CPU 8, which functions as the header information print controller 105, actuates the print head 3 while driving the paper transporter 5 to feed the receipt sheet 4 at the paper feed speed V1 in the forward direction, and continuously controls the driving of the paper transporter 5 and the print head 3 until the pieces of header information read from the nonvolatile memory 11 are all printed on the receipt sheet 4 (in steps S9 and S10).

The paper feed speed at this time is limited to the paper feed speed V1 already described above, since it is necessary to realize the cooperative operation of the paper transporter 5 with the print head 3.

A time period, in which the paper feed speed V1 for printing the header information continues, is denoted by reference T5 in the timing chart of FIG. 7.

If all the pieces of header information read from the nonvolatile memory 11 are printed on the receipt sheet 4 and the determination result of the step S10 becomes "yes", then the final printing position of the stamp logo area 7*a* of the receipt sheet 4 on which the header information is printed is positioned to the printing position A on the paper transport path, whereby the respective portions of the receipt printer 1 return to their initial states individually.

If it is determined that the printing of the header information is finished, the CPU 8, which functions as the print start timing controller 101, turns into a standby state for repeatedly executing the determination processings of the steps S1 and S3 again.

If the CPU 8, which functions as the print start timing controller 101, detects a print instruction which means an instruction to print the dealing information, the CPU 8, which functions as the dealing information print controller 102, restarts the above operation. The CPU 8 repeatedly executes the same processings to issue a receipt 7 related to the next dealing.

As stated so far, in the time period from the detection of the input of the print instruction to the completion of the feeding and cutting-off of the receipt 7, the receipt printer 1 in this embodiment executes only the print processing for printing the dealing information on the dealing result printing area 7*b* and the high-speed paper feeding at the paper feed speed V2F, thereby promptly issuing the receipt 7. Therefore, the time required to perform an operation for issuing the receipt 7 can be advantageously, remarkably reduced, as compared with the conventional receipt issuing method and receipt printer (disclosed in the Japanese Patent Unexamined Application Publication No. 7-182565 or the like) in which the header information is printed on the stamp logo area 7*a* at the limited feed speed in the time period from the detection of the input of the print instruction to the completion of the feeding and cutting-off of the receipt. Particularly, if the inkjet or thermal print head 3 for color printing or the like which is slow in printing speed is used, the improvement of the time required to perform the operation for issuing the receipt 7 is remarkable.

Furthermore, it takes the same printing time period as that required in the conventional receipt issuing method and receipt printer to print the header information on the stamp logo area 7*a*. In this embodiment, however, a phase for executing the operation for printing the header information differs from that in the conventional receipt issuing method and receipt printer (disclosed in the Japanese Patent Unexamined Application Publication No. 7-182565 or the like), and this header information print operation is performed within the standby time required right after the completion of issuance until a data input operation for dealing with the next customer starts. Due to this, even if the time period required to perform the header information print operation is slightly long, the problem that the time period for performing the receipt issuing operation itself increases does not occur. This is because the time period T4 required to rewind the receipt 4 and the time period T5 required to print the header information are included and absorbed into the standby time for awaiting the next issuing operation as shown in FIG. 7. In this case, the operation for rewinding the receipt 4 is also executed at the speed V2B, so that the sum of the rewinding time period T4 and the printing, time period T5 is shortened and the overall required time period can be easily included in the standby phase.

The flow chart of FIG. 5 shows an example of the simplest processing operation. Actually, it is also possible to execute drive-controlling of the respective portions of the receipt printer 1 and a data input processing for inputting data from the barcode reader 16 and the keyboard 17 as independent time-division processings (multitask processings) by a single CPU, i.e., the CPU 8, in parallel. In that case, even in the time period T4 required to rewind the receipt 4 and the time period T5 required to print the header information, it is possible to receive data from the barcode reader 16 and the keyboard 17, and to perform addition, multiplication, subtraction processings and the like. As a result, the standby time right from the completion of the issuance of the receipt to the start of the operation for dealing with the next customer substantially falls in the time zone right after the issuance of the receipt until the operation of the dealing complete key related to the dealing with the next customer (the output of a print instruction) starts.

In other words, it is possible to perform the rewinding of the receipt sheet 4 and the header information print operation in parallel with the data input operation and the arithmetic processings related to the next customer. The time required to rewind the receipt sheet 4 and to print the header information is shorter than the time normally required to perform the data input operation related to the next customer and to service the customer. Due to this, no matter when a register corner is crowded with customers, it is possible to completely include the time period T4 required to rewind the receipt sheet 4 and the time period T5 required to perform the operation for printing the header information on the receipt sheet 4 in this standby time. It is therefore possible to ensure reducing the time to perform the operation for issuing the receipt 7.

In this embodiment, an example in which the drive control on the respective portions of the receipt printer 1 and the data input processing for inputting data from the barcode reader 16 and the keyboard 17 are performed as independent time-division processings by a single CPU, i.e., the CPU 8, has been described. Alternatively, the data input processing for inputting data from the barcode reader 16 and the keyboard 17 may be performed by a POS terminal-dedicated CPU and only the drive control over the respective portions of the receipt printer 1 may be performed by the CPU 8. In this case, the same advantages as those stated above can be attained.

Namely, the standby time right after the completion of issuing the receipt 7 until the operation for dealing with the next customer starts falls in the time zone right after the completion of issuing the receipt 7 until the operation of the dealing complete key related to the dealing with the next customer. It is, therefore, possible to perform the rewinding of the receipt sheet 4 and the header information print operation in parallel with the data input operation and arithmetic processings related to the next customer. Even in the circumstances in which the register corner is crowded with customers, it is possible to accelerate the receipt issuing operation, almost irrespectively of the time period T4 required to rewind the receipt sheet 4 and the time period T5 required to perform the header information print operation.

If the POS terminal-dedicated CPU and the CPU 8 of the receipt printer 1 operate in parallel, the CPU 8 of the receipt printer 1 does not need to execute the processings of the steps S1 and S2 shown in FIG. 5 but need to execute only the processings of the steps S3 to S10 shown in FIG. 5.

Another embodiment of a receipt printer, to which the receipt issuing method according to the present invention is applied, will next be described briefly with reference to FIG. 8.

Figure 8:
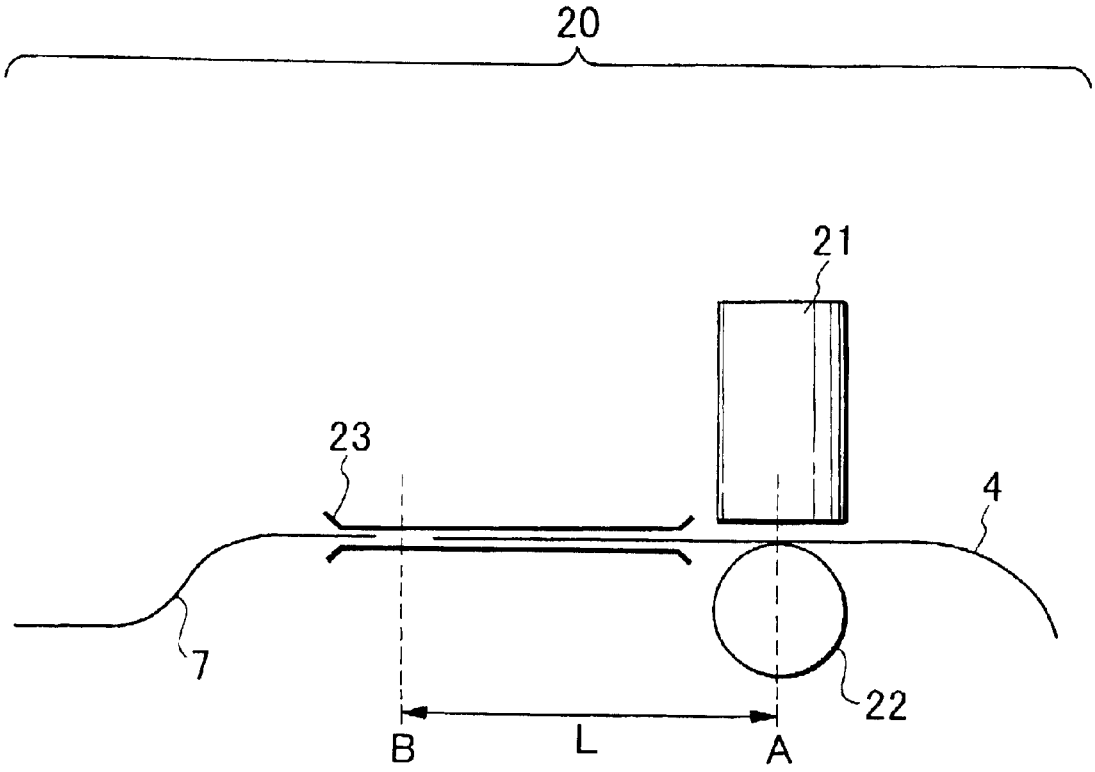
FIG. 8 is a typical view showing the arrangement of the mechanical constituent elements of a receipt printer in another embodiment, to which the receipt issuing method according to the present invention is applied, in a simplified manner.

As shown in FIG. 8, a receipt printer 20 in this embodiment consists of a print head 21 for printing header information, such as a logo, common to receipts and dealing information specific to each receipt, a paper transporter 22 for feeding a receipt sheet 4 in forward and backward directions, and a cutter 23 which cuts off a printed portion on the tip end of the receipt sheet 4 to make the printed portion into a receipt 7.

Among these constituent elements, the structures of the print head 21 and the paper transporter 22 are the same as those of the print head 3 and the paper transporter 5 of the receipt printer 1 described with reference to FIG. 1. The cutter 23 is a manual tearing-off type cutter provided with a saw-tooth cutting edge and differs from the cutter 6 shown in FIG. 1 in that the structure of the cutter is simplified.

The constitution of a controller which controls the driving of this receipt printer 20 is substantially equal to that of the controller 2 described with reference to FIG. 2 except that the driver 14 is not provided in the controller because of the manual cutter 23.

To control the driving of the receipt printer 20, it is possible to apply the important portions of the receipt issuing processing shown in FIG. 5 to the receipt printer 20 as they are. However, in the receipt printer 20 in this embodiment which applies the manual tearing-off type cutter 23, the receipt cutoff processing of the step S7 is manually performed. It is, therefore, necessary to determine whether a register clerk has cut off the tip end of the receipt sheet 4 to provide the receipt 7 by some method before the rewinding of the receipt sheet 4 starts.

In normal register operation, changes and the receipt 7 are given to a customer and then a data input operation related to the next dealing is started. Therefore, after the completion of the receipt output processing in the step S6, not the processing in the step S7 but a determination processing for awaiting data input (key operation) from the barcode reader 16 or the keyboard 17 and for starting the processing in the step S8 when the start of the first data input is detected, may be performed. Needless to say, a dedicated manual rewinding switch independent of the data input keys and barcode reader 16 may be disposed so that the processing in the step S8 may be started when the operation of this manual rewinding switch is detected.

According to the receipt issuing method and the receipt printer of the present invention, only the print processing for printing the dealing information and the paper feed are executed in the time period from the detection of the input of the print instruction to the completion of the output and cutoff of the receipt, thereby promptly issuing the receipt. Therefore, the time required to perform an operation for issuing the receipt can be remarkably reduced as compared with the conventional receipt issuing method and receipt printer (disclosed in the Japanese Patent Unexamined Application Publication No. 7-182565 or the like) in which the paper feed speed is limited during the above-stated process to feed the paper and print the header information such as a logo.

Accordingly, particularly if the inkjet or thermal print head for color printing or the like which is slow in printing speed is used and a logo which corresponds to multimedia terminal is printed, it is advantageously possible to attain a smooth receipt issuing operation while conducting file color printing.

Further, during the paper feed which follows the dealing information printing processing so as to output the receipt, the paper feed speed is accelerated as compared with that for normal print operation. It is, therefore, possible to further reduce the time required to perform the receipt issuing operation.

On the other hand, if the header information such as a logo is printed, printing time period in accordance with the processing ability of the print head is required. According to the present invention, the phase for executing the operation for printing the header information differs from that in the conventional receipt issuing method and receipt printer (disclosed in the Japanese Patent Unexamined Application Publication No. 7-182565 or the like), and this header information print operation is performed within the standby time period (spare time required for receiving payments, giving changes, and servicing customers, which allows, in general, time of a few seconds to several tens of seconds) required right after the completion of issuance and before a data input operation for dealing with the next customer starts. Due to this, even if the time required to perform the header information print operation is slightly long, a disadvantage that the time for performing the receipt issuing operation itself increases does not occur.

By printing the header information such as a logo using a spare time period during the receipt issuing operation, the time required to print the header information is absorbed in the spare time period. As a result, even if the header information such as a logo is printed by two-color printing or multicolor printing using the inkjet or thermal print head, it is possible to realize a sufficiently high-speed receipt issuing operation as a whole. Therefore, there is no need to newly develop a special print head employed to perform the high-speed receipt issuing operation by the two-color printing or the multicolor printing. Besides, by improving only the internal processing of the controller (software) while applying the conventionally print head, paper transporter, cutter and the like to the present invention, it is possible to reduce the time period required to perform the receipt issuing operation. It is, therefore, possible to provide a receipt printer for two-color printing or multicolor printing at low cost without increasing product development cost and manufacturing cost.

Needless to say, the application of the receipt issuing method and the receipt printer according to the present invention is not limited to the apparatus equipped with the inkjet or thermal print head or the like. The receipt issuing method and the receipt printer according to the present invention can be also applied to a receipt printer of line thermal type, dot impact type or the like capable of performing high-speed printing. Even in the line thermal or dot impact receipt printer for monochrome printing capable of performing high-speed printing, the receipt sheet feed speed of the operation which is not accompanied with the print operation is always faster than that of the operation which is accompanied with the print operation. Quite obviously, therefore, by executing only the dealing information print processing and the paper feed during the time period from the detection of the input of a print instruction to the completion of the output and cutoff of the receipt, and by printing the header information such as a logo during the standby time period right after the completion of issuance of the receipt bofore the data input operation for dealing with the next customer starts, it is possible to reduce the time required to perform the receipt issuing operation.

What is claimed is:

1. A receipt issuing method for issuing a receipt comprising the steps of:

printing dealing information with a print head while feeding a receipt sheet in a forward direction with a transporter;

feeding said receipt sheet in the forward direction with said transporter until an end of said receipt about reaches a cutter;

cutting the receipt sheet with said cutter to make a cutoff portion of said receipt sheet into said receipt;

feeding said receipt sheet in a reverse direction with said transporter until a top of said receipt sheet about reaches said print head; and printing header information with said print head while feeding said receipt sheet in the forward direction with said transporter.

2. A receipt issuing method for issuing a receipt comprising the steps of:

printing dealing information with a print head while feeding a receipt sheet in a forward direction with a transporter;

feeding said receipt sheet in the forward direction with said transporter until an end of said receipt about reaches a manual cutter;

detecting whether or not the receipt sheet has been cut with said manual cutter to make a cutoff portion of said receipt sheet into said receipt;

if it is detected that the receipt sheet has been cut, feeding said receipt sheet in a reverse direction with said transporter until a top of said receipt sheet about reaches said print head; and printing header information with said print head while feeding said receipt sheet in the forward direction with said transporter.

3. A computer program product embodied on a computer-readable medium and comprising codes that, when executed, cause a computer to perform a receipt issuing method for issuing a receipt comprising the steps of:

printing dealing information with a print head while feeding a receipt sheet in a forward direction with a transporter;

feeding said receipt sheet in the forward direction with said transporter until an end of said receipt about reaches a cutter;

cutting the receipt sheet with said cutter to make a cutoff portion of said receipt sheet into said receipt;

feeding said receipt sheet in a reverse direction with said transporter until a top of said receipt sheet about reaches said print head; and printing header information with said print head while feeding said receipt sheet in the forward direction with said transporter.

4. A computer program product embodied on a computer-readable medium and comprising codes that, when executed, cause a computer to perform a receipt issuing method for issuing a receipt comprising the steps of:

printing dealing information with a print head while feeding a receipt sheet in a forward direction with a transporter;

feeding said receipt sheet in the forward direction with said transporter until an end of said receipt about reaches a manual cutter;

detecting whether or not the receipt sheet has been cut with said manual cutter to make a cutoff portion of said receipt sheet into said receipt;

if it is detected that the receipt sheet has been cut, feeding said receipt sheet in a reverse direction with said transporter until a top of said receipt sheet about reaches said print head; and printing header information with said print head while feeding said receipt sheet in the forward direction with said transporter.

5. A receipt printer for issuing a receipt comprising:

means for printing dealing information with a print head while feeding a receipt sheet in a forward direction with a transporter;

means for feeding said receipt sheet in the forward direction with said transporter until an end of said receipt about reaches a cutter;

means for cutting the receipt sheet with said cutter to make a cutoff portion of said receipt sheet into said receipt;

means for feeding said receipt sheet in a reverse direction with said transporter until a top of said receipt sheet about reaches said print head; and means for printing header information with said print head while feeding said receipt sheet in the forward direction with said transporter, wherein a same side of said receipt sheet is printed by said printing header information means and said printing dealing information means.

6. A receipt printer according to claim 5, wherein said cutting means is disposed forward of said printing header information means, with respect to the forward direction of movement of said receipt sheet by said transporter.

7. A receipt printer for issuing a receipt comprising:

means for printing dealing information with a print head while feeding a receipt sheet in a forward direction with a transporter;

means for feeding said receipt sheet in the forward direction with said transporter until an end of said receipt about reaches a manual cutter;

means for detecting whether or not the receipt sheet has been cut with said manual cutter to make a cutoff portion of said receipt sheet into said receipt;

means for feeding said receipt sheet in a reverse direction with said transporter until a top of said receipt sheet about reaches said print head if it is detected that the receipt sheet has been cut; and means for printing header information with said print head while feeding said receipt sheet in the forward direction with said transporter, wherein a same side of said receipt sheet is printed by said printing header information means and said printing dealing information means.

8. A receipt printer according to claim 7, wherein said manual cutter is disposed forward of said printing header information means, with respect to the forward direction of movement of said receipt sheet by said transporter.

* * * * *